US007854248B2

(12) United States Patent
Coleman et al.

(10) Patent No.: US 7,854,248 B2
(45) Date of Patent: Dec. 21, 2010

(54) VISION PANEL FOR MOVABLE PARTITION, MOVABLE PARTITIONS AND RELATED METHODS

(75) Inventors: W. Michael Coleman, Salt Lake City, UT (US); Michael D. George, Kaysville, UT (US); E. Carl Goodman, Bountiful, UT (US)

(73) Assignee: Won-Door Corporation, Salt Lake City, UT (US)

( * ) Notice: Subject to any disclaimer, the term of this patent is extended or adjusted under 35 U.S.C. 154(b) by 221 days.

(21) Appl. No.: 12/060,161

(22) Filed: Mar. 31, 2008

(65) Prior Publication Data

US 2008/0244991 A1 Oct. 9, 2008

Related U.S. Application Data

(60) Provisional application No. 60/920,690, filed on Mar. 29, 2007.

(51) Int. Cl.
*E06B 3/48* (2006.01)
*E05D 15/26* (2006.01)

(52) U.S. Cl. ..... 160/118; 160/199

(58) Field of Classification Search ..... 160/84.03, 160/84.06, 84.08, 118, 196.1, 197, 199, 201, 160/206

See application file for complete search history.

(56) References Cited

U.S. PATENT DOCUMENTS

| | | | | | |
|---|---|---|---|---|---|
| 3,979,861 | A | * | 9/1976 | Fromme et al. | 52/71 |
| 4,199,018 | A | * | 4/1980 | Hirschel et al. | 160/84.08 |
| 4,724,884 | A | * | 2/1988 | Weem | 160/84.08 |
| 4,763,712 | A | * | 8/1988 | van der Klaauw | 160/84.08 |
| 4,867,221 | A | * | 9/1989 | Dixon et al. | 160/84.08 |
| 4,924,929 | A | * | 5/1990 | Johnson et al. | 160/84.08 |
| 4,930,276 | A | * | 6/1990 | Bawa et al. | 52/211 |
| 5,207,044 | A | * | 5/1993 | LaSee | 52/476 |

* cited by examiner

*Primary Examiner*—Blair M. Johnson
*Assistant Examiner*—Jeremy C Ramsey
(74) *Attorney, Agent, or Firm*—TraskBritt

(57) ABSTRACT

Apparatuses and methods are provided for visual inspection across a barrier such as a fire door. In one embodiment of the present invention, a first movable partition is disposed adjacent, and laterally spaced from, a second movable partition. A first vision panel is disposed in the first partition and a second vision panel is disposed in the second partition in substantial alignment with the first vision panel. The position of the first vision panel is substantially constrained with respect to the position of the second vision panel along a first longitudinal direction. The first vision panel and the second vision panel are enabled to exhibit a desired amount of lateral displacement relative to each other.

19 Claims, 8 Drawing Sheets

VISION PANEL FOR MOVABLE PARTITION, MOVABLE PARTITIONS AND RELATED METHODS

CROSS-REFERENCE TO RELATED APPLICATION

The present application claims the benefit of U.S. Provisional Application Ser. No. 60/920,690 entitled VISION PANEL FOR MOVABLE PARTITION, MOVABLE PARTITIONS AND RELATED METHODS filed on Mar. 29, 2007, the disclosure of which is incorporated by reference herein in its entirety.

TECHNICAL FIELD

The present invention relates to generally movable partitions and, more particularly, to movable partitions, such as fire barriers, having vision panels installed therein, and to related components and methods.

BACKGROUND

Moveable partitions are utilized in numerous situations and environments for a variety of purposes. Such partitions may include for example, foldable or collapsible doors configured to close-off an opening in order to enclose a room or to subdivide a single large room into one or more smaller rooms.

Moveable partitions may also be used to act as security barriers, fire barriers, or as both. In such a case, the moveable partition may be configured to automatically close upon the occurrence of a predetermined event such as the actuation of an associated alarm. For example, one or more moveable partitions may be configured as a fire door or barrier wherein each door is formed with a plurality of panels connected to each other by way of hinge mechanisms. The hinged connection of the panels enables the door to fold up in a compact unit on one side of the opening or it may be stored in a pocket formed within a wall, which is designed to conceal the door and preserve the aesthetics of the room where the door is installed. When deployment of the door is necessary, the door is driven by a motor along a track, which track may be incorporated into a header above the door, until the leading edge of the door engages a mating structure.

When such a door or partition is used, for example, as a fire barrier, it often becomes difficult for someone on one side of the barrier to know or to determine what is taking place on the other side of the barrier. For example, it may be difficult to determine whether the room or area on an opposing side of the barrier is filled with smoke, if flames have reached the room, or if individuals are trapped on the other side of the barrier. While it is possible to open the barrier a limited distance to try and inspect what is happening on the other side, such an action may have dire consequences by enabling a fire to penetrate the opening previously closed off by the barrier.

Some attempts have been made at providing windows or vision panels in such partitions. However, such attempts have sometimes been difficult to implement from a manufacturing standpoint as well as from a standpoint of providing appropriate functionality, of both the partition and the window, while also maintaining desired aesthetics.

In accordance with certain embodiments of the present invention, a moveable partition is provided having an apparatus, structure, mechanism or other means that enable inspection of an area on one side of the partition from an opposing side of the partition while the partition is in a deployed or closed state. Additionally, some embodiments include partitions configured as a fire barrier wherein the inspection structure or device is configured to withstand the high temperatures associated with a fire without compromising the integrity of the fire barrier.

BRIEF SUMMARY OF THE INVENTION

The present invention provides various embodiments of movable partitions or doors that may be used, for example, as fire barriers or security barriers and that include the ability to inspect an area on an opposing side of the partition while the partition is in an extended or deployed state.

In accordance with one embodiment of the present invention, a barrier such as a folding door is provided. The folding door includes a first movable partition having a first plurality of panels and at least a first hinge structure having a vision panel. The at least a first hinge structure is disposed between two adjacent panels of the first plurality of panels. A second movable partition includes a second plurality of panels and at least a second hinge structure having a vision panel. The at least a second hinge structure is disposed between two adjacent panels of the second plurality of panels. Additionally, the at least a second hinge structure is laterally spaced from and longitudinally aligned with the hinge structure of the first partition. At least one bracket assembly is disposed between the hinge structure of the first partition and the hinge structure of the second partition. The at least one bracket assembly, the at least a first hinge structure and the at least a second hinge structure are cooperatively coupled with one another to substantially restrain longitudinal movement of the at least a first hinge structure relative to the at least a second hinge structure while permitting lateral movement of the at least a first hinge structure relative to the at least a second hinge structure.

In accordance with another embodiment of the present invention, a method of providing inspection from a first side of a barrier, such as a fire door, to a second side of the barrier is provided. The method includes disposing a first movable partition adjacent, and laterally spaced from, a second movable partition. A first vision panel is disposed in the first partition and a second vision panel is disposed in the second partition in substantial alignment with the first vision panel. The position of the first vision panel is substantially constrained with respect to the position of the second vision panel along a longitudinal direction. The first vision panel and the second vision panel are enabled to exhibit a desired amount of lateral displacement relative to each other.

BRIEF DESCRIPTION OF THE SEVERAL VIEWS OF THE DRAWINGS

The foregoing and other advantages of the invention will become apparent upon reading the following detailed description and upon reference to the drawings in which.

DETAILED DESCRIPTION OF THE INVENTION

Figure 1:
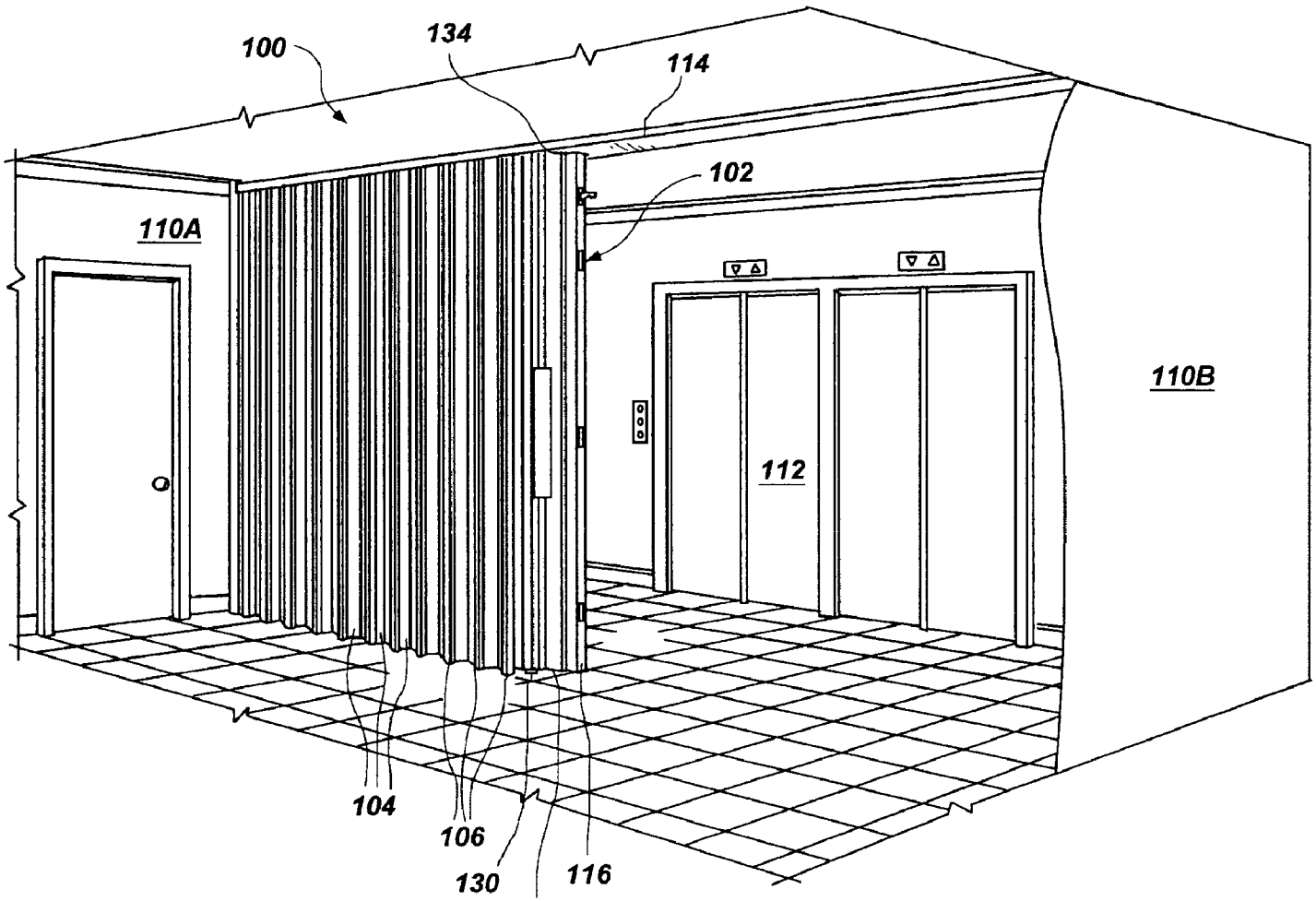
FIG. 1 is a perspective view of a system and movable partition in accordance with an embodiment of the present invention.
Figure 2:
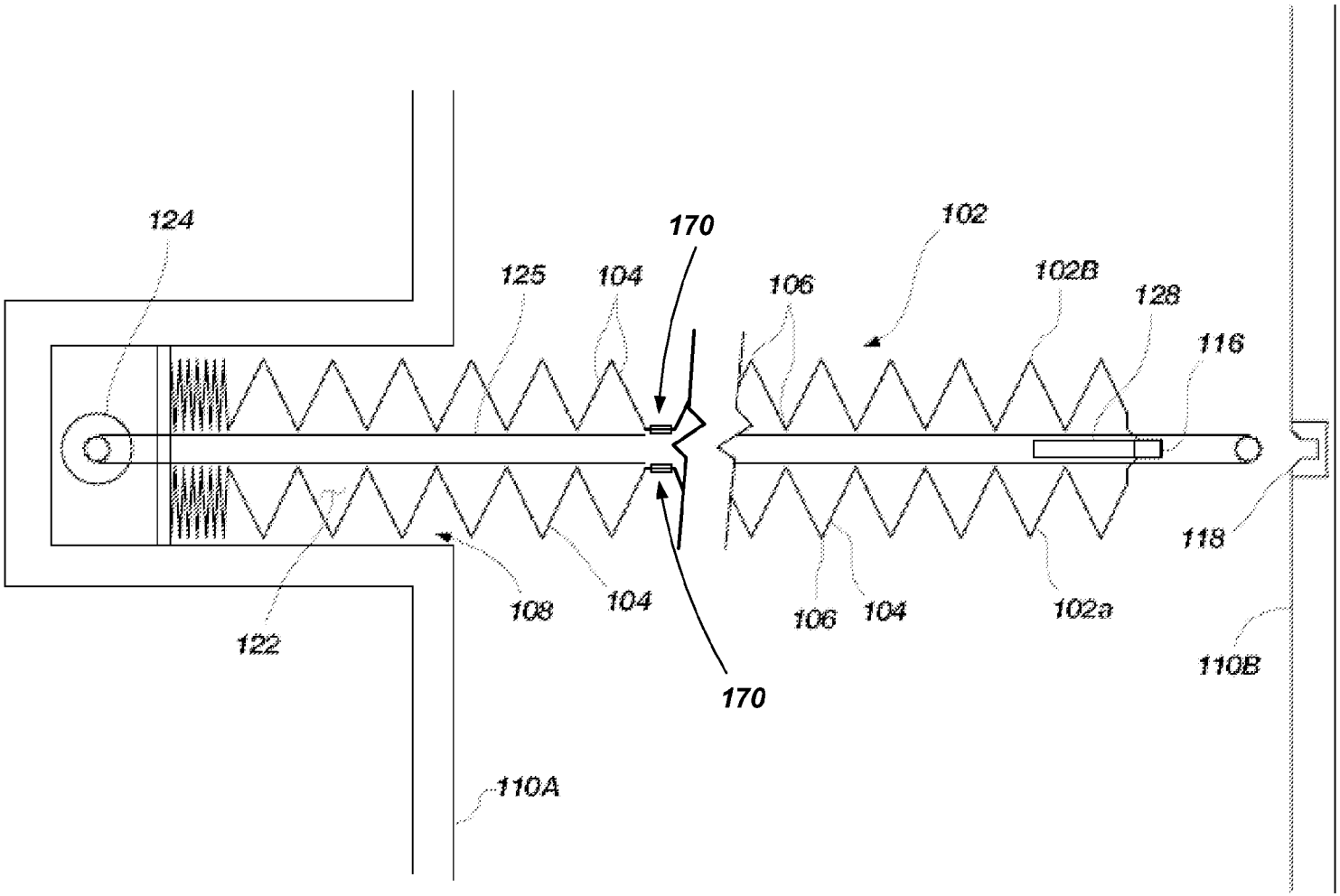
FIG. 2 is a plan view of the partition shown in FIG. 1.
Figure 3:
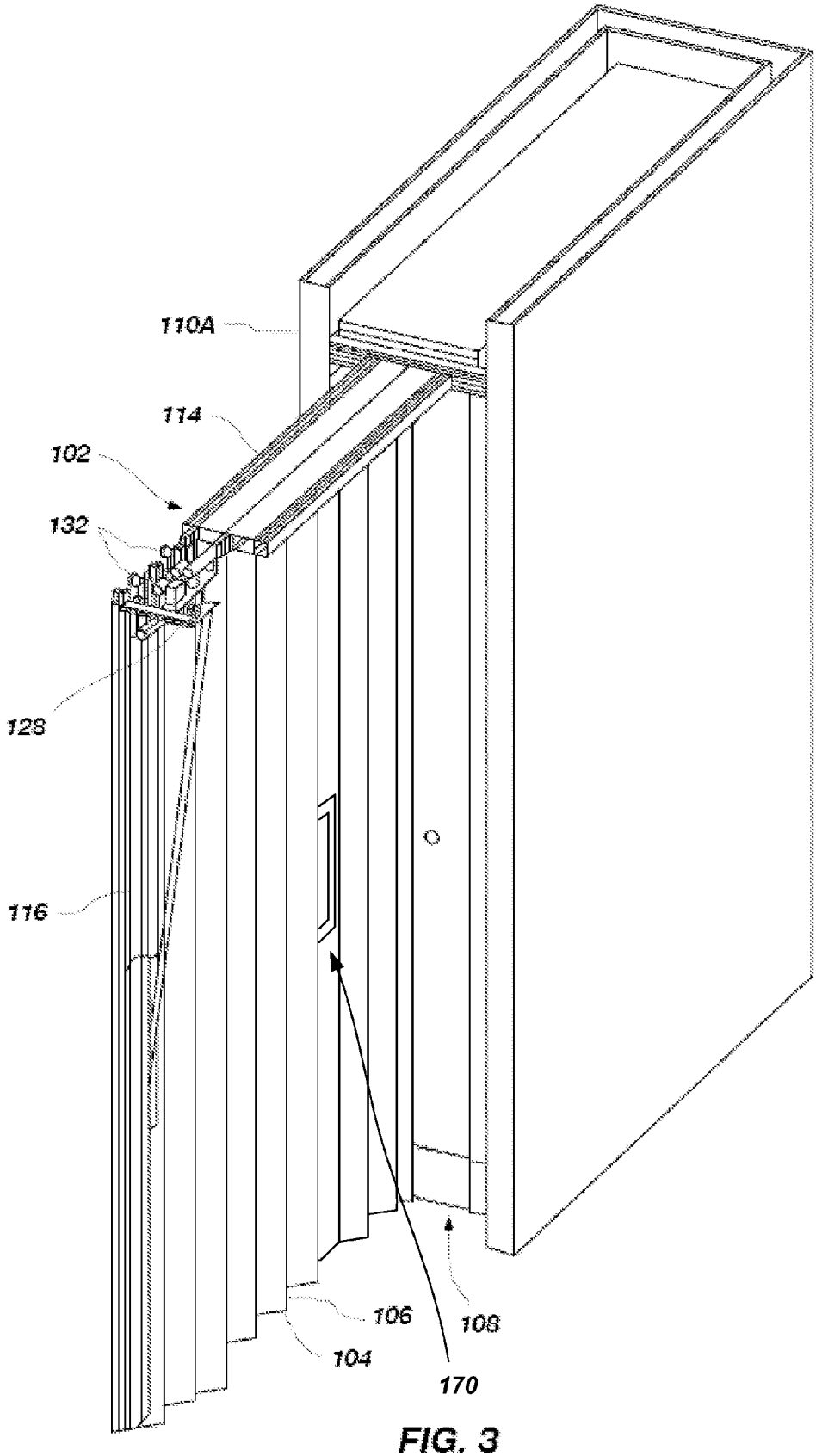
FIG. 3 a perspective view of a movable partition shown in FIGS. 1 and 2 with various components and sections stripped away to show certain details in accordance with an embodiment of the present invention.

Referring to FIGS. 1 through 3, a system 100 is shown that includes a movable partition, for example, in the form of an accordion-type door 102. The door 102 may be used, for example, as a security door, a fire door, for subdividing a larger space into smaller rooms or areas, as a sound barrier or as a combination of such purposes. The door 102 may be formed with a plurality of panels 104 with adjacent panels 104 being connected to one another with hinges 106 or other hinge-like members. The hinged connection of the individual panels 104 enables the panels 104 to fold relative to each other in an accordion or a plicated manner such that the door 102 may be compactly stored in a pocket 108 formed in a wall 110A of a building when in a retracted or folded state.

When it is desired to deploy the door 102 to an extended position, for example, to secure an area such as an elevator lobby 112 or other area during a fire, the door 102 is displaced along a track 114 across the space to provide an appropriate barrier. When in a deployed or an extended state, a leading edge of the door 102, shown as a male lead post 116, complementarily or matingly engages with a jamb or door post 118 that may be formed in a wall 110B of a building.

As can perhaps be best seen in FIG. 2, an accordion-type door 102 may include a first accordion-style partition 102A and a second accordion-style partition 102B that is laterally spaced from the first partition 102A. Such a configuration may be utilized, for example, as a fire door wherein the first partition 102A acts as a primary fire and smoke barrier, the space 122 between the two partitions 102A and 102B acts as an insulator or a buffer zone, and the second partition 102B acts as a secondary fire and smoke barrier. In another application, the first partition 102A may act as a primary sound barrier, the space 122 between the two partitions 102A and 102B may again act as an insulator or a buffer zone, and the second partition 102B may act as a secondary sound barrier.

A drive, which may include, for example, a motor 124 and a transmission member such as a drive belt or chain 125 (FIG. 2), may be configured to open and close the door 102 upon actuation thereof A trolley 128 is coupled to a portion of the chain 125 and configured to ride or slide along the track 114. The trolley 128 may be coupled to, for example, the lead post 116 such that displacement of the trolley 128 results in corresponding displacement of the lead post 116 and the partitions 102A and 102B attached thereto.

The door 102 also includes one or more vision panels 170 that may be used to view activities occurring on one side of the door 102 from the other side of the door 102 while the door 102 is in a deployed or extended state. For example, in one embodiment, aligned vision panels 170 may be disposed in each of the space partitions 102A and 102B to enable one to view activities on an opposing side of the door 102. Embodiments of such vision panels 170 will be described in further detail hereinbelow.

Figure 4:
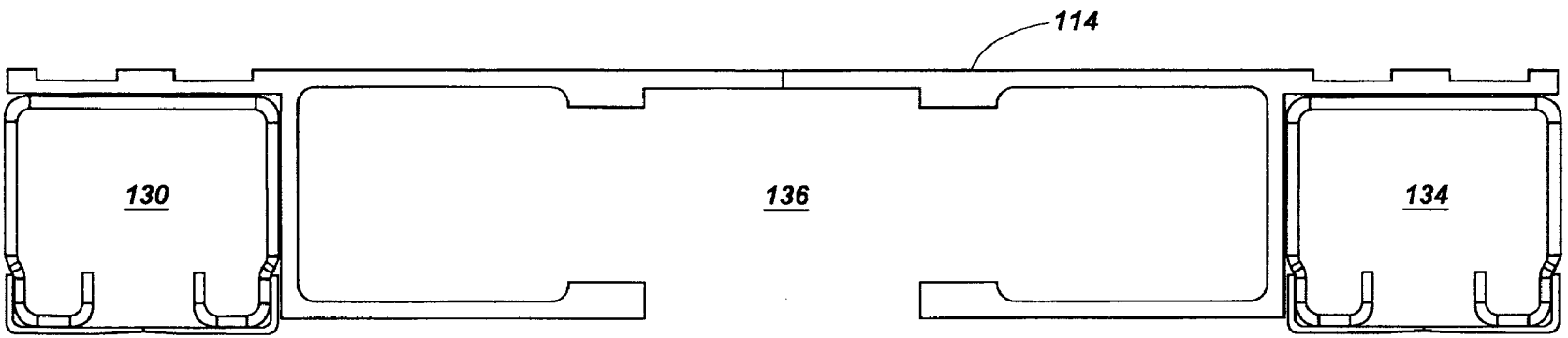
FIG. 4 is an end view of an overhead track used in certain embodiments of the present invention.

Referring briefly now to FIG. 4, an end view of a track 114 that may be used in accordance with an embodiment of the present invention is shown. A first channel 130 of the track 114 may be configured for receipt of individual slide mechanisms or rollers 132 (FIG. 3) that may be attached to individual panels 104 associated with a first partition (e.g., partition 102A) while a second channel 134 may be configured for receipt of similar slide mechanisms or rollers 132 associated with a second partition (e.g., partition 102B). A central channel 136 may be disposed between the two partition channels 130 and 134 and may be configured for receipt of the trolley 128 as well as provide a raceway for the belt or chain 125.

It is noted that, while the presently described embodiment is more specifically described in terms of a single accordion-type door 102, other movable partitions may be utilized. For example, a two-door, or bi-part door, system may be utilized wherein two similarly configured doors extend across a space and join together to form an appropriate barrier. Additionally, multi-part doors may be utilized where multiple doors meet at a common door post or other structure. Also, the present invention is applicable to movable partitions or barriers other than the accordion-type doors that are specifically shown and described herein.

Figure 5:
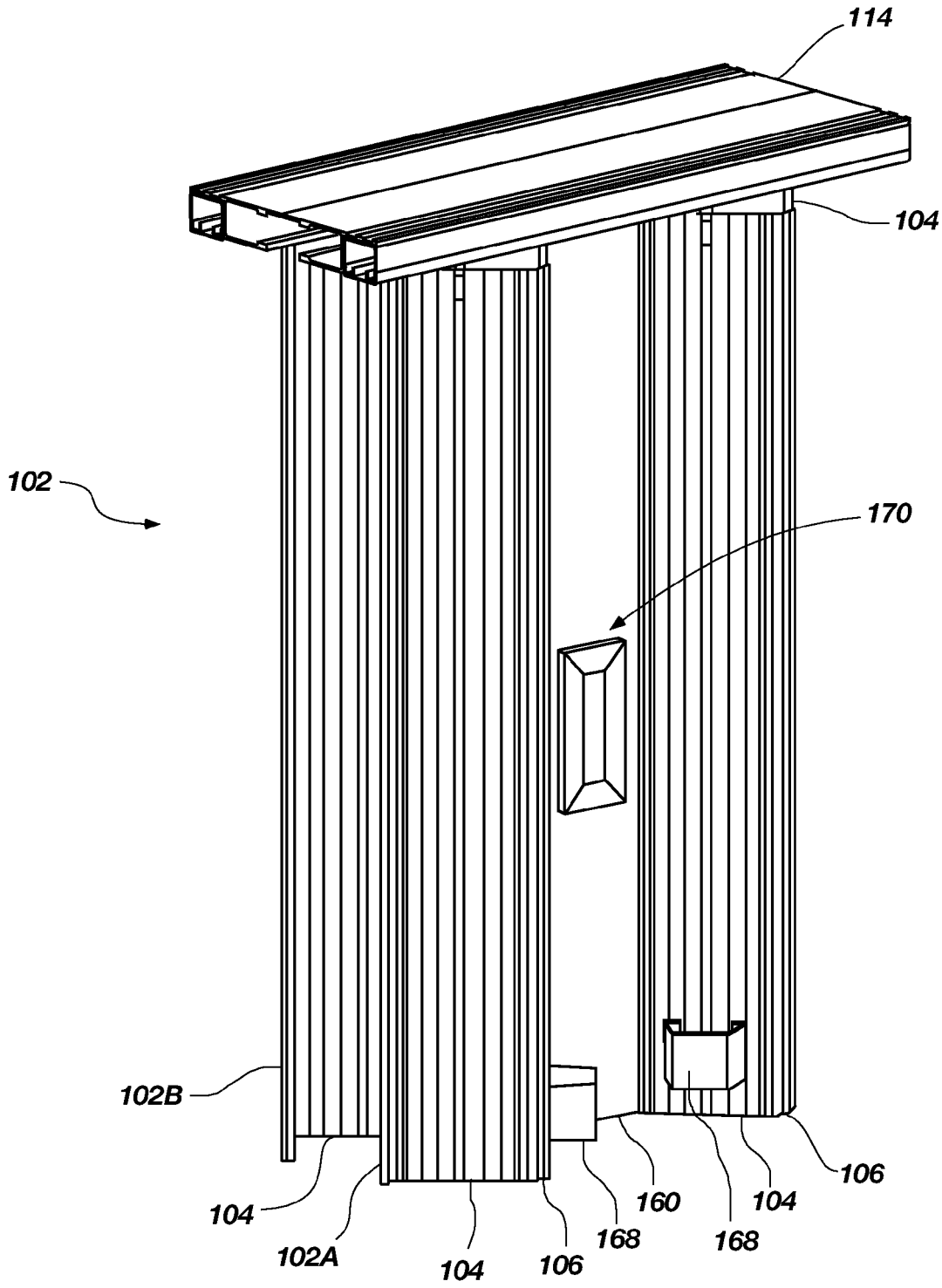
FIG. 5 is a perspective view of a portion of a movable partition shown in FIGS. 1 through 3.
Figure 6:
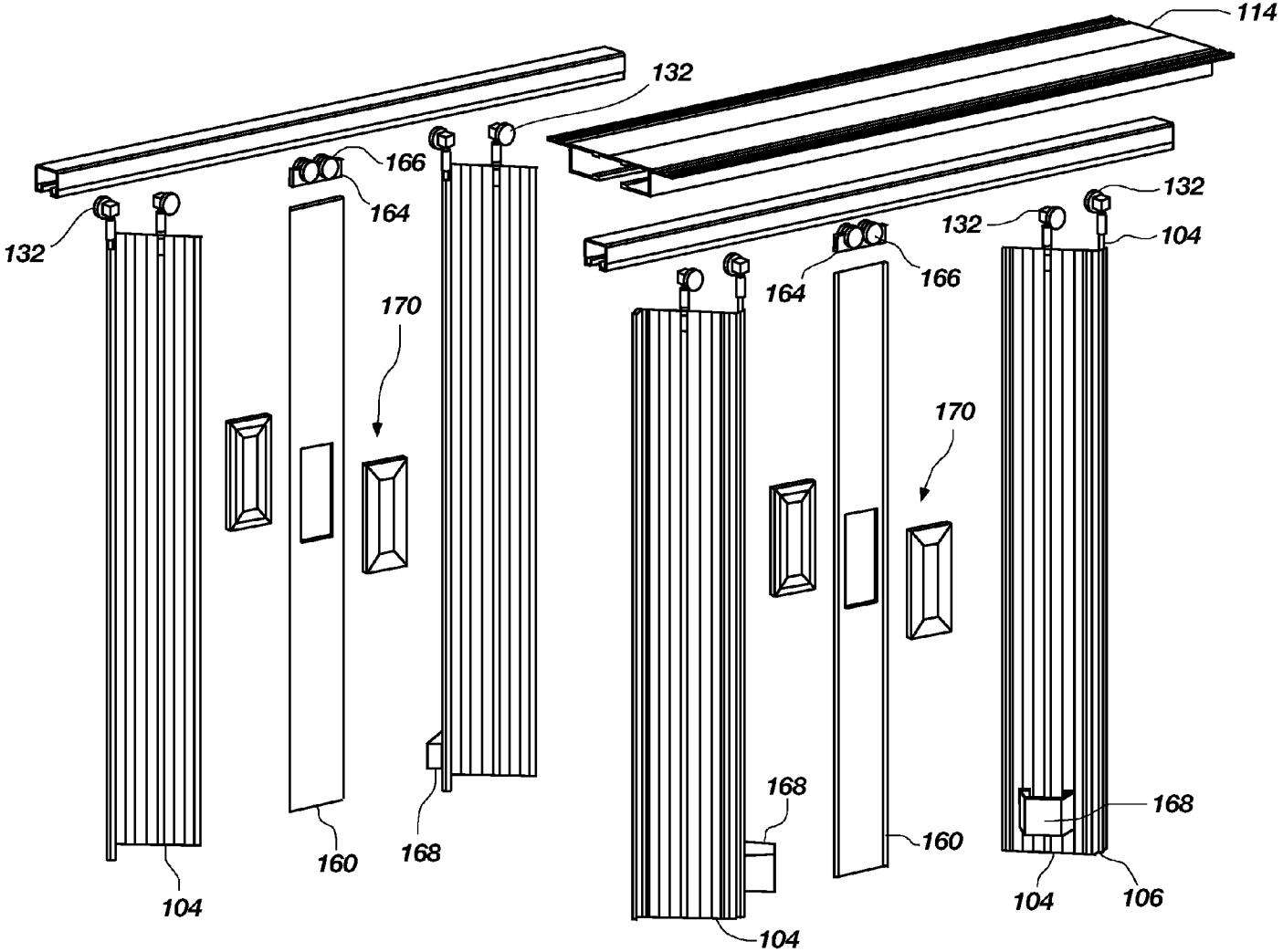
FIG. 6 is an exploded view of the portion shown in FIG. 5.

Referring now to FIGS. 5 and 6, a portion of a door 102 is shown in accordance with a particular embodiment of the present invention. FIG. 5 depicts an assembled portion of the door 102, while FIG. 6 depicts an exploded view of the same portion of the door 102. As has been discussed above, the door 102 may include a first partition 102A and a second, laterally spaced partition 102B. The partitions 102A and 102B each include a plurality of panels 104 coupled together with hinges 106. The panels 104 are each coupled with respective portions of a track 114 by way of sliding mechanisms or rollers 132 such that they may be displaced along a pathway generally defined by the track 114.

In accordance with one embodiment of the present invention, a separate or additional panel, referred to herein as a hinge panel 160 for purposes of convenience and clarity, is coupled between two adjacent panels 104 of a partition 102A and 102B and acts as a hinge between two adjacent panels while also providing longitudinal spacing (i.e., in the direction along the path defined by the track 114) between such panels 104. In other words, the hinge panel 160 may be a structure that is formed to be generally similar to the hinges 106 while exhibiting a greater width than such hinges 106 such that adjacent panels 104 coupled with the hinge panel 160 are spaced from each other a greater longitudinal distance as compared to adjacent panels 104 that are coupled with the hinges 106.

In one embodiment, the hinge panels 160 may also be coupled to a portion of the track 114 by way of associated sliding mechanisms or rollers (e.g., similar to slide mechanisms or rollers 132 associated with the panels 104). However, in another embodiment, to enable the hinge panel 160 to be laterally displaced (i.e., substantially transverse to the direction along the path defined by the track 114) when the door 102 is being deployed or retracted, a spacer 164 may be coupled to sliding mechanisms or rollers 166 and configured to engage or otherwise interact with a portion of the track 114 at a location generally above the hinge panel 160 and longitudinally between the adjacent door panels 104 coupled with the hinge panel 160. In some embodiments, the spacer 164 may be configured to engage the adjacent panels 104 and act as an abutment when they rotate to a certain position relative to the hinge panel 160 to help prevent the adjacent panels 104 that are coupled with the hinge panel 160 from over-rotating during stacking thereof (e.g., when being folded and stored in the pocket 108 as shown in FIG. 2). In one embodiment, the sliding mechanisms or rollers 166 may be configured to contact and roll along a surface of the track 114, while still enabling lateral displacement of the hinge panel 160 during opening and closing of the door 102.

In another embodiment, structures may be coupled to the lower portion of adjacent panels 104 that may act as spacers or bumpers 168. The spacers or bumpers 168 also help to prevent over-rotation of the associated panels 104 during stacking of the panels 104 and placing the door 102 in a stored or stowed state. In other words, when the door 102 is being retracted and stacked or folded, the bumpers 168 of adjacent panels 104 may contact each other to prevent further rotational displacement of their associated panels 104. Multiple spacers or bumpers 168 may be used in association with a given hinge panel 160. For example, two or more sets or pairs of spacers or bumpers 168 may be spaced along the height of adjacent panels 104 depending, for example, on the height of the door 102. In some embodiments, the spacers or bumpers 168 may be used in addition to the spacer 164 coupled to the upper end of the hinge panel 160.

Still referring to FIGS. 5 and 6, a vision panel 170 is associated with each hinge panel 160. The vision panel 170 formed in the first partition 102A and the vision panel 170 formed in the second partition 102B are substantially aligned such that a person standing on one side of the door 102 (when it is in a deployed or extended state) can look through the vision panel 170 in one partition (e.g., 102A), through the aligned vision panel 170 in the other, laterally spaced partition (e.g., 102B), and be able to visually inspect the area on the opposing side of the door 102.

Figure 7:
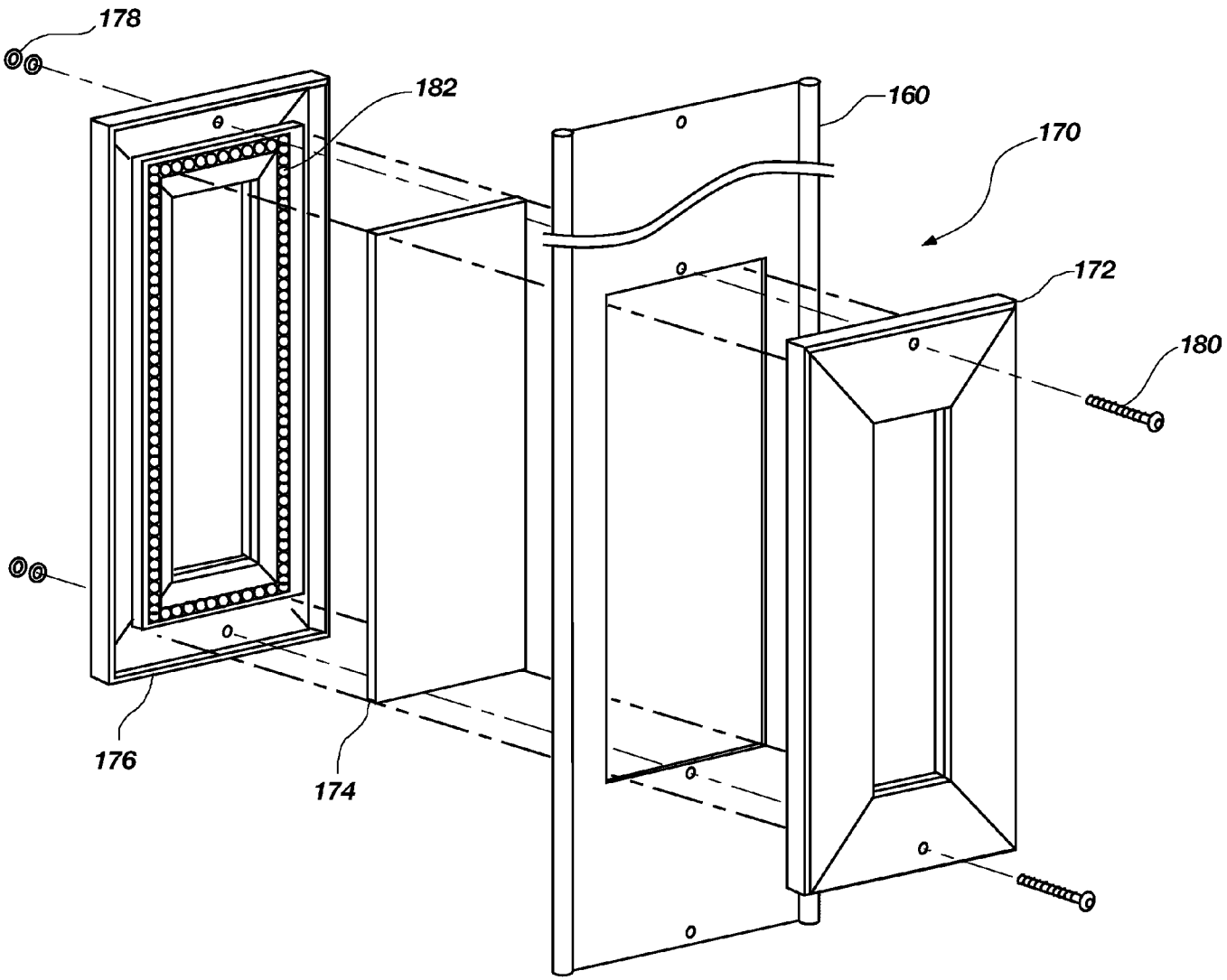
FIG. 7 is an exploded view of a vision panel in accordance with an embodiment of the present invention.

Referring briefly to FIG. 7, an exploded view of a vision panel 170 is shown according to an embodiment of the present invention. The vision panel 170 may include a first frame member 172 or similar structure positioned on a first side of the hinge panel 160, a glass plate 174 (which may be fire rated) or similar structure disposed on a second side of the hinge panel 160, and a second frame member 176 disposed on the second side of the hinge panel 160 such that the glass plate 174 and hinge panel 160 are sandwiched between the two frame members 172 and 176. Fasteners, such as nuts 178 and bolts 180, screws, rivets, or other fastening means, may be used to couple the frame members 172 and 176 and hinge panel 160 with one another. A sealant 182, such as, for example, silicone caulking, may be disposed between each of the frame members 172 and 176 and the glass plate 174 to seal the vision panel 170 and reduce or eliminate fluid flow (e.g., air, smoke) through the partitions 102A and 102B at the locations of the vision panels 170. Additionally, the sealant 182 may help to reduce vibrations from being transferred through the vision panel 170.

In one embodiment, the vision panel 170, when assembled, may be configured to withstand exposure to a fire for a specified period of time such that the door 102 may act as a fire barrier without being compromised by the existence of the vision panel 170. For example, in one particular embodiment, a door 102 having a vision panel 170 that includes fire rated glazing for the glass plate 174 may be rated as a three (3) hour door under appropriate fire rating standards.

Figure 8:
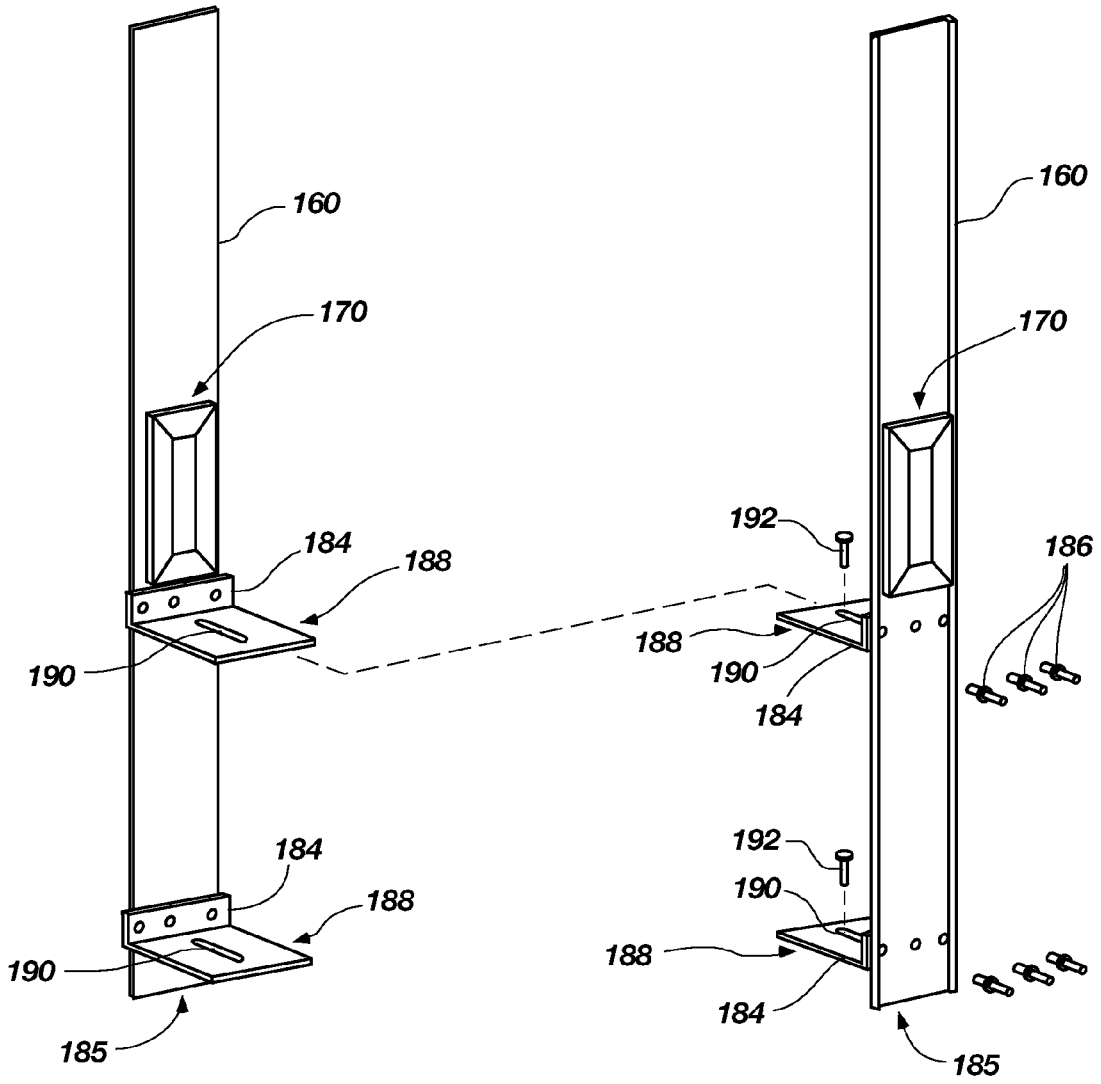
FIG. 8 is a perspective view of two laterally spaced corresponding hinge panels in accordance with an embodiment of the present invention.

Referring briefly to FIG. 8, further details are shown with regard to hinge panels 160 that may be used in accordance with an embodiment of the present invention. One or more brackets 184 may be coupled to each hinge panel 160 to help maintain alignment of the hinge panels 160 (and, thus, maintain alignment of the associate vision panels 170) of a given pair of hinge panels 160.

For example, a first bracket 184 may be coupled to a hinge panel 160 on an interior side thereof (i.e., at a location such that a portion of the bracket 184 extends into the space 122 between the two partitions 102A and 102B as shown in FIG. 2). In one particular embodiment, the bracket 184 may be positioned at a location approximately 6 to 8 inches above a bottom edge 185 of the hinge panel 160. In one embodiment, another bracket 184 may be coupled to the hinge panel 160 on an interior side thereof and at a location adjacent (e.g., just below or just above) the vision panel 170. The brackets 184 may be configured, for example, as angles or L-shaped brackets, and coupled to the hinge panel 160 by way of screws, rivets, or other appropriate fasteners 186.

The brackets 184 of two corresponding hinge panels 160 (i.e., the aligned hinge panels 160 of the first partition 102A and the second partition 102B) may be coupled to one another so that the two corresponding hinge panels 160 are substantially maintained in longitudinal alignment through repeated deployment and retraction of the door 102. For example, in one embodiment, a laterally extending portion 188 of each bracket 184 may be fastened to the laterally extending portion 188 of a corresponding bracket 184. In one embodiment, slots 190 may be formed in the laterally extending portions 188 of each bracket 184, with slots 190 of corresponding brackets 184 being aligned and a fastener 192 being disposed in each pair of aligned slots 190 to slidably couple corresponding brackets 184 with one another. Such a configuration enables the brackets, and thus the hinge panels 160, to be laterally displaced relative to one another within a desired range or distance, while substantially constraining relative longitudinal displacement of corresponding hinge panels 160. In other words, such a configuration enables the hinge panels 160 to be displaced laterally towards and away from each other, while maintaining a desired line of sight through the corresponding vision panels 170.

It is noted that, while a single hinge panel 160 (with associated vision panel 170) is shown in each partition 102A and 102B, such is for convenience of description and one of ordinary skill in the art would recognize that multiple pairs of aligned hinge panels 160 may be disposed at longitudinally spaced locations in the door 102 such that the door 102 includes multiple points through which one can see from a first side of the door 102 to the opposing side of the door 102.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the spirit and scope of the invention as defined by the following appended claims.

What is claimed is:

1. A folding door comprising:

a first movable partition having a first plurality of panels;

at least a first hinge structure disposed between two adjacent panels of the first plurality of panels, wherein the at least a first hinge structure includes a vision panel providing a visual path therethrough;

a second movable partition having a second plurality of panels;

at least a second hinge structure disposed between two adjacent panels of the second plurality of panels, wherein the at least a second hinge structure includes a vision panel providing a visual path therethrough, the at least a second hinge structure being laterally spaced from and longitudinally aligned with the at least a first hinge structure of the first movable partition; and at least one bracket assembly disposed between the at least a first hinge structure of the first movable partition and the at least a second hinge structure of the second movable partition, the at least one bracket assembly, the at least a first hinge structure and the at least a second hinge structure being cooperatively coupled with one another to at least substantially restrain longitudinal movement of the at least a first hinge structure relative to the at least a second hinge structure while permitting lateral movement of the at least a first hinge structure relative to the at least a second hinge structure.

2. The folding door of claim 1, further comprising at least one spacer associated with the first movable partition, the at least one spacer being sized, configured and located to limit rotation of at least one of the adjacent panels relative to the at least a first hinge structure.

3. The folding door of claim 2, wherein the at least one spacer is located adjacent an upper edge of the at least a first hinge structure.

4. The folding door of claim 3, further comprising at least one of a roller and a sliding structure coupled with the at least one spacer.

5. The folding door of claim 2, wherein the at least one spacer includes a first spacer coupled with a first adjacent panel and a second spacer coupled with a second adjacent panel, and wherein the first spacer and the second spacer are configured to abut one another upon rotation of the first adjacent panel and the second adjacent panel toward one another.

6. The folding door of claim 1, wherein the at least one bracket assembly includes a first bracket coupled with the at least a first hinge structure, a second bracket coupled with the at least a second hinge structure, and wherein the first bracket and the second bracket are slidably coupled with one another.

7. The folding door of claim 1, wherein the at least one bracket assembly includes a plurality of bracket assemblies.

8. The folding door of claim 6, wherein the first bracket is located between a lower edge of the at least a first hinge structure and the vision panel of the at least a first hinge structure.

9. The folding door of claim 1, wherein the vision panel of the at least a first hinge structure includes:

a first frame member disposed on a first side of the at least a first hinge structure;

a second frame member disposed on a second, opposing side of the at least a first hinge structure; and a plate of glass disposed between the first frame member and the second frame member.

10. The folding door of claim 9, further comprising a sealant disposed between the at least a first hinge structure and at least one of the first frame member and the second frame member.

11. The folding door of claim 1, wherein the at least a first hinge structure includes a first plurality of hinge structures each having a vision panel and wherein the at least a second hinge structure includes a second plurality of hinge structures each having a vision panel, and wherein each hinge panel of the first plurality is longitudinally aligned with an associated hinge panel of the second plurality.

12. A method of providing inspection from a first side of a fire door to a second side of a fire door, the method comprising:

disposing a first movable partition adjacent, and laterally spaced from, a second movable partition;

disposing a first vision panel in a first hinge structure separating adjacent panels of the first movable partition, the first vision panel providing a visual path through the first hinge structure;

disposing a second vision panel in a second hinge structure separating adjacent panels of the second movable partition in substantial alignment with the first vision panel, the second vision panel providing a visual path through the second hinge structure;

at least substantially constraining a position of the first vision panel with respect to a position of the second vision panel along a longitudinal direction; and enabling limited displacement of the first vision panel with respect to the second vision panel in a lateral direction, substantially transverse to the longitudinal direction.

13. The method according to claim 12, wherein substantially constraining a position of the first vision panel with respect to a position of the second vision panel along a longitudinal direction further includes coupling at least one bracket assembly to the first movable partition and the second movable partition.

14. The method according to claim 13, wherein coupling at least one bracket assembly to the first movable partition and the second movable partition further includes coupling a first bracket to the first movable partition and coupling a second bracket to the second movable partition, and wherein enabling limited displacement of the first vision panel with respect to the second vision panel in a lateral direction further includes slidably coupling the first bracket with the second bracket.

15. The method according to claim 13, wherein coupling at least one bracket assembly to the first movable partition and the second movable partition includes coupling a plurality of bracket assemblies to the first movable partition and to the second movable partition.

16. The method according to claim 12, further comprising limiting rotation of the adjacent panels of the first movable partition relative to the first hinge structure and limiting rotation of the adjacent panels of the second movable partition relative to the second hinge structure.

17. The method according to claim 16, wherein limiting rotation of the adjacent panels of the first movable partition relative to the first hinge structure includes abutting at least one of the adjacent panels of the first movable partition with a spacer member disposed adjacent an upper edge of the first hinge structure.

18. The method according to claim 16, wherein limiting rotation of the adjacent panels of the first movable partition relative to the first hinge structure includes coupling a first spacer to one of the adjacent panels of the first movable partition, coupling a second spacer to another of the adjacent panels of the first movable partition, and abutting the first spacer with the second spacer upon rotation of the adjacent panels of the first movable partition towards one another.

19. The method according to claim 12, further comprising providing a fluid seal in at least the first vision panel from a first side of the first movable partition to a second side of the first movable partition.

* * * * *